US010648151B2

(12) United States Patent
Rainey

(10) Patent No.: US 10,648,151 B2
(45) Date of Patent: May 12, 2020

(54) RETAINING WALL BLOCK MOLD AND METHOD

(71) Applicant: Earth Wall Products, LLC, Marietta, GA (US)

(72) Inventor: Thomas L. Rainey, Marietta, GA (US)

(73) Assignee: EARTH WALL PRODUCTS, LLC, Marietta, GA (US)

( * ) Notice: Subject to any disclaimer, the term of this patent is extended or adjusted under 35 U.S.C. 154(b) by 379 days.

(21) Appl. No.: 15/479,853

(22) Filed: Apr. 5, 2017

(65) Prior Publication Data

US 2018/0290331 A1 Oct. 11, 2018

(51) Int. Cl.

| | |
|---|---|
| ***E02D 29/02*** | (2006.01) |
| ***B28B 13/06*** | (2006.01) |
| ***B28B 7/00*** | (2006.01) |
| ***B28B 7/10*** | (2006.01) |

(52) U.S. Cl.

CPC ..... *E02D 29/0266* (2013.01); *B28B 7/007* (2013.01); *B28B 7/0044* (2013.01); *B28B 7/0073* (2013.01); *B28B 7/10* (2013.01); *B28B 13/06* (2013.01); *E02D 29/02* (2013.01); *E02D 2200/1628* (2013.01); *E02D 2250/0007* (2013.01); *E02D 2300/0001* (2013.01); *E02D 2300/002* (2013.01); *E02D 2300/0026* (2013.01)

(58) Field of Classification Search

CPC ..... E02D 29/0266; E02D 2250/0007; E02D 2200/1628; E02D 2300/0001; E02D 29/02; E02D 2300/0026; E02D 2300/002; B28B 13/06; B28B 7/10; B28B 7/0073; B28B 7/007; B28B 7/0044; B28B 13/04; B28B 13/062; B28B 15/005; B29C 43/04; B29C 31/047; Y10S 425/118

USPC ..... 249/18–50, 66.1–77, 117–123, 136–138, 249/160–172; 425/DIG. 118, 441, 444

See application file for complete search history.

(56) References Cited

U.S. PATENT DOCUMENTS

| | | | | | |
|---|---|---|---|---|---|
| 1,645,776 | A | * | 10/1927 | Sanson | B28B 7/0044 249/104 |
| 1,754,484 | A | * | 4/1930 | Pelton | B28B 13/06 425/441 |
| 3,627,861 | A | * | 12/1971 | Timke | B28B 7/0064 264/680 |
| 3,665,821 | A | * | 5/1972 | Walker | E01C 19/4893 404/98 |

(Continued)

*Primary Examiner* — Leith S Shafi

(74) *Attorney, Agent, or Firm* — Thomas | Horstemeyer, LLP

(57) ABSTRACT

Embodiments of a mold for making a retaining wall blocks are disclosed. The mold enables blocks to be made more quickly by enabling separation of each block from the mold housing when the block is cured sufficiently to enable separation. Once separated, the block can be permitted to fully cure away from the mold housing, while the mold housing is re-used to produce one or more other blocks. In one embodiment, among others, the mold has a movable bottom tray and a mold housing with at least one door. The mold housing has an opening designed to receive and introduce a fabrication material, such as concrete, into the cavity. Once a block is sufficiently cured, it is separated from the mold housing on the tray through the at least one door, and a new tray is inserted in the mold housing to make another block.

13 Claims, 7 Drawing Sheets

(56) References Cited

U.S. PATENT DOCUMENTS

| | | | | |
|---|---|---|---|---|
| 3,824,059 | A * | 7/1974 | Heltzel | B28B 7/10 425/424 |
| 4,243,198 | A * | 1/1981 | Beretta | B28B 13/06 249/161 |
| 4,921,204 | A * | 5/1990 | Melfi | B28B 7/02 249/155 |
| 5,484,236 | A | 1/1996 | Gravier | |
| 6,773,642 | B1 | 8/2004 | Wardell | |
| 7,267,321 | B1 | 9/2007 | Morrell | |
| 7,780,141 | B2 | 8/2010 | Dawson et al. | |
| 7,972,128 | B2 | 7/2011 | Mugge et al. | |
| 2006/0145050 | A1 | 7/2006 | Price et al. | |
| 2016/0201287 | A1 | 7/2016 | Karau | |
| 2016/0326743 | A1 | 11/2016 | Matys | |

* cited by examiner

RETAINING WALL BLOCK MOLD AND METHOD

FIELD OF INVENTION

The present invention generally relates to molds for creating structures, and more particularly, to re-usable molds for creating retaining wall blocks for retaining walls.

BACKGROUND OF THE INVENTION

Retaining wall blocks are commonly made from concrete or rebar reinforced concrete. A re-usable metal mold is designed to make the blocks and defines their shape, size, and outer geometry. The mold typically has one or more doors at its top and one or more holes at its top for injecting mixed concrete to cure, or harden, over time. Once the mold is designed and fabricated and is in use, rebar is often positioned in the mold, and the mold is filled with concrete. The concrete is permitted to cure, or harden. Once the concrete is cured, which can take many hours, the doors of the mold are opened, and the retaining wall block is removed, oftentimes with a crane due to its heavy weight. The curing time for a retaining wall block is dependent upon the shape, size, and outer geometry, and sometimes it can be a very long length of time, for example, a 24 hour period, which undesirably reduces throughout.

SUMMARY OF INVENTION

The present disclosure provides various embodiments of a retaining block mold and method for making retaining wall blocks. The mold enables the blocks to be made more quickly than in previous designs by enabling separation of each block from the mold housing when the block is not completely cured but is cured sufficiently enough to enable separation. Once separated, the block can be permitted to fully cure away from the mold housing, while the mold housing is re-used to produce one or more other blocks.

One embodiment, among others, is a mold for making a retaining wall block. The mold has a movable bottom tray and a mold housing. The mold housing has a plurality of sides, an open bottom, and at least one door in one of the sides. The open bottom has the movable bottom tray installed or situated therein to close the bottom of the mold housing. The at least one door is shaped and of sufficient size to define an opening to enable the retaining wall block to be moved through when opened. The at least one door is designed to close the one side of the housing when closed. The mold housing has an internal cavity therein that defines an outer shape of the retaining wall block. The mold housing has an opening designed to receive and introduce fabrication material (e.g., rebar and concrete) into the cavity.

Another embodiment, among others, is a method for manufacturing retaining wall blocks by using the mold defined in the previous paragraph. This method can be broadly summarized as follows: (a) introducing the fabrication material into the cavity of the mold housing; (b) permitting the fabrication material to cure to a sufficient extent to enable withdrawal of a first retaining wall block from the mold housing; (c) separating the bottom tray in combination with the first retaining wall block from the mold housing by opening the doors and moving the combination out of the doors through the one side of the mold housing; (d) moving a second bottom tray into the mold housing and repeating steps (a) through (c) in order to create a second retaining wall block, while the first retaining wall block fully cures separately from the mold housing to an extent to when the first retaining wall block can be lifted by itself without damage.

Another embodiment, among others, is a mold for making retaining wall blocks. The mold has a means for supporting at a bottom of the mold the retaining wall block. The mold as a means for housing and defining, in combination with the supporting means, a cavity, which defines an outer surface of the retaining wall block. The housing means also has a means for introducing fluidized fabrication material into the cavity. Finally, the mold has a means for enabling movement of the retaining wall block, once sufficiently cured, in combination with the support means, from a side of the housing means to separate the combination from the housing means.

Another embodiment, among others, is a method for manufacturing retaining wall blocks by using the mold defined in the previous paragraph. This method can be broadly summarized as follows: (a) introducing the fabrication material into the cavity of the housing means; (b) permitting the fabrication material to cure to a sufficient extent to enable withdrawal of a first retaining wall block from the housing means; (c) separating the supporting means in combination with the first retaining wall block from the housing means by moving the combination out of the one side of the housing means; (d) moving a second supporting means into the housing means and repeating steps (a) through (c) in order to create a second retaining wall block, while the first retaining wall block fully cures separately from the housing means to an extent to when the first retaining wall block can be lifted by itself without damage.

Other embodiments, apparatus, devices, features, characteristics, and methods of the present invention will become more apparent in the Detailed Description of Invention section and accompanying drawings and claims, all of which form a part of this specification.

BRIEF DESCRIPTION OF THE DRAWINGS

The various embodiments and features of the invention will be clearly depicted in the following drawings. The components in the drawings are not necessarily to scale, emphasis instead being placed upon clearly illustrating the principles of the embodiments of the present disclosure. Moreover, in the drawings, like reference numerals designate corresponding parts throughout the several views.

DETAILED DESCRIPTION OF THE PREFERRED EMBODIMENT

Figure 1:
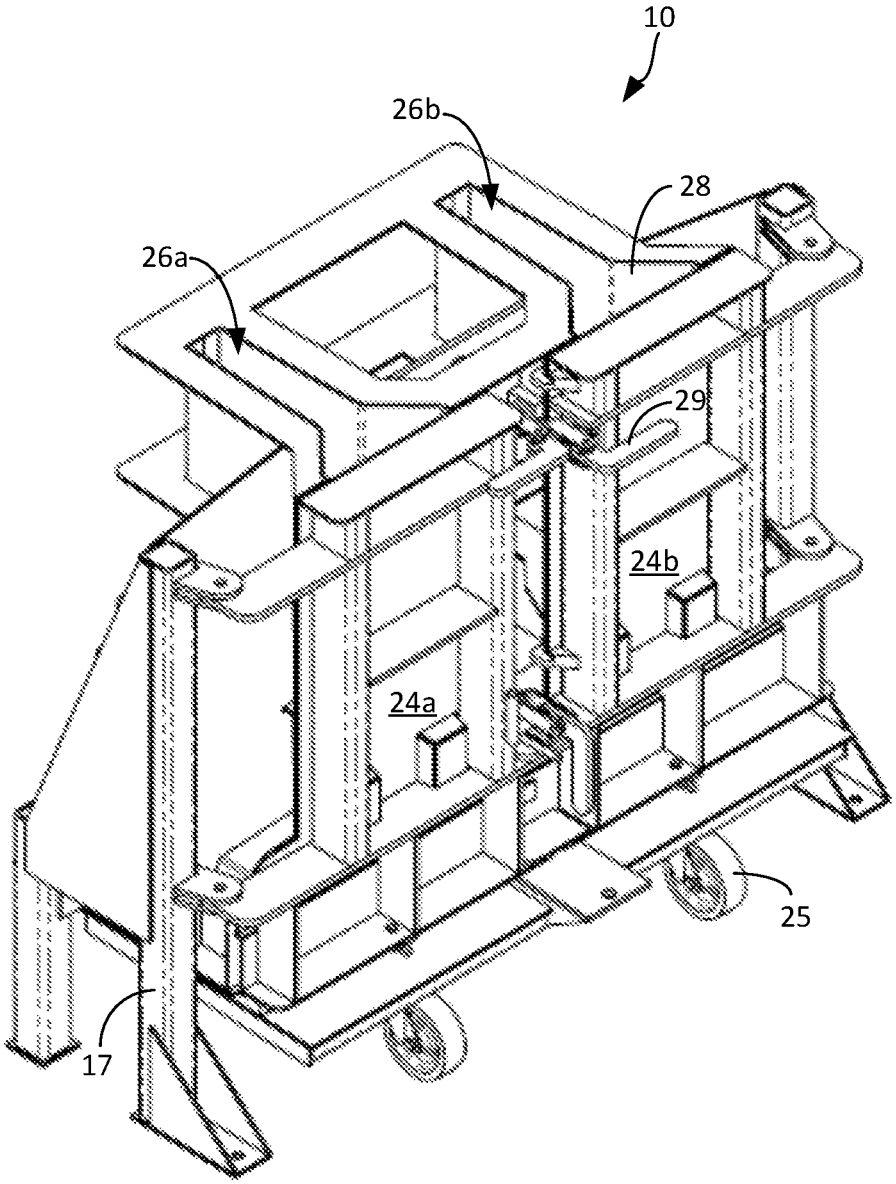
FIG. 1 is a perspective view of an embodiment of a mold, in a closed configuration, as provided by the present disclosure.
Figure 7A:
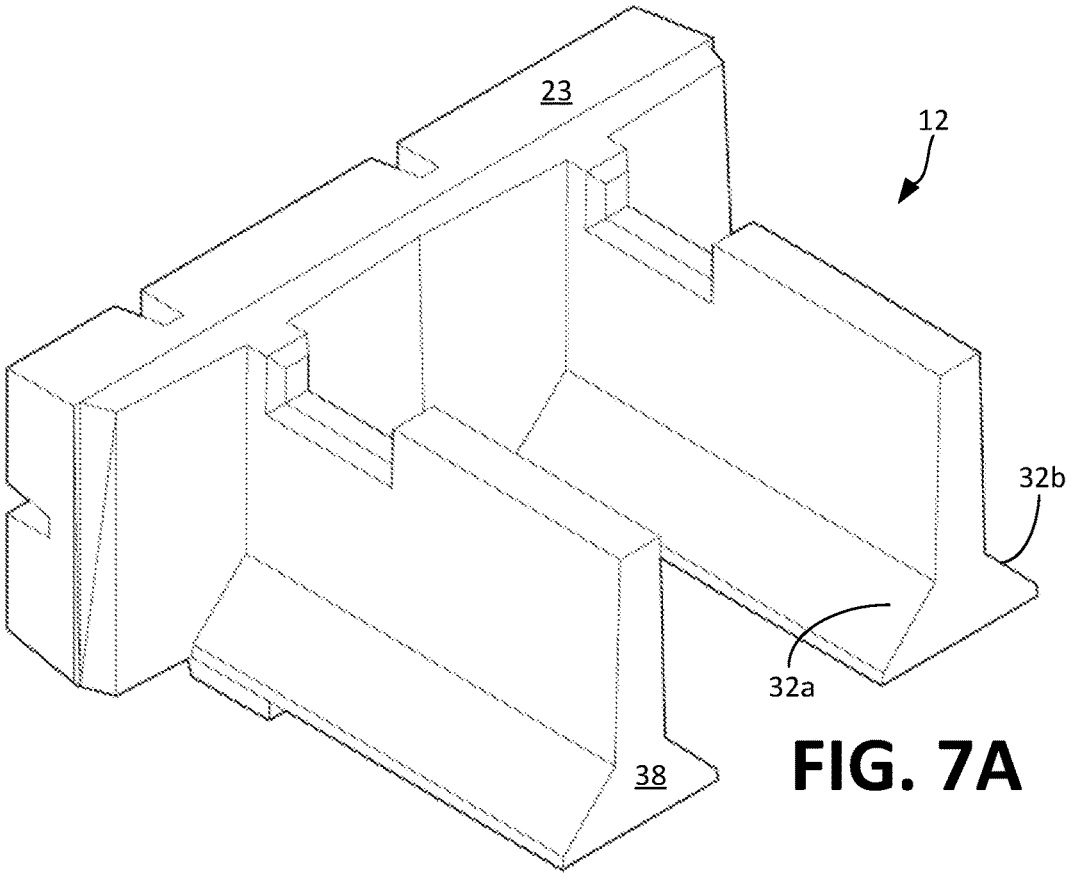
FIG. 7A is a rear perspective view of the retaining wall block manufactured using the mold of FIG. 1.
Figure 7B:
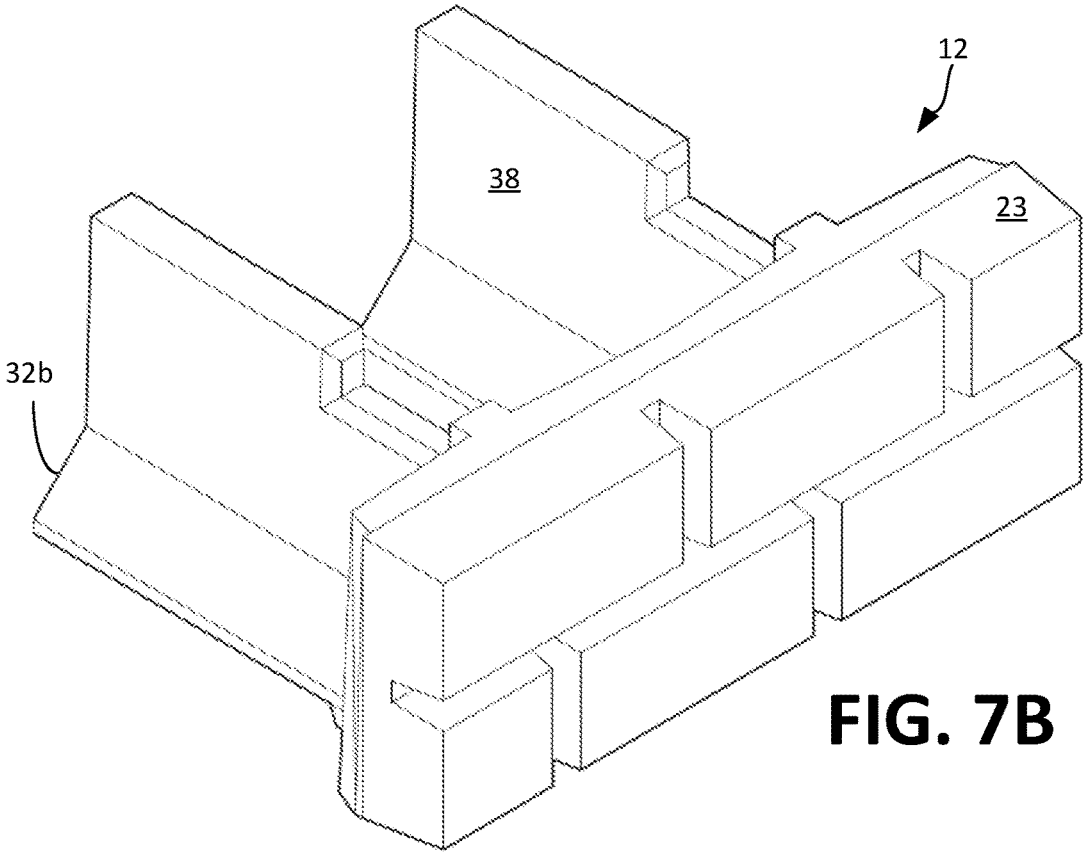
FIG. 7B is a front perspective view of the retaining wall block of FIG. 7B.

The present disclosure provides various embodiments of a retaining block mold 10 of FIG. 1 for making retaining wall blocks 12, an example of which is shown in FIGS. 7A and 7B. This block example is currently being sold and is commercially available under the trademark FORIX from Earth Wall Products, LLC, Georgia, U.S.A. The mold 10 enables the blocks 12 to be made more quickly than in previous designs by enabling separation of each block 12 from the main mold housing 14 when the block 12 is not completely cured but is cured sufficiently enough to enable separation. Once separated, the block 12 can be permitted to fully cure away from the mold housing 14, while the mold housing 14 is re-used to produce one or more other blocks 12.

The blocks 12 can be made from a variety of fabrication materials, but in the preferred embodiment, the blocks 12 are made from rebar re-enforced concrete. The mold 10 can also be made from a variety of materials, but in the preferred embodiment, the mold 10 is made from a metal, such as steel, with sufficient thickness and shape to handle very heavy rebar re-enforced concrete structures.

As illustrated in FIGS. 1 through 6, the preferred embodiment of the mold 10 has a movable bottom tray 16 that is removably installed or secured at the bottom of the main mold housing 14. In this embodiment, the bottom tray is generally planar, having a top side 18 and a bottom side 22, and a generally rectangular periphery. The top side 18 of the tray 16 can have a removable insert (not shown) with a textured surface or can be textured itself to thereby impose a corresponding textured surface on front portion 23 (an example of which is shown in FIG. 7A) of the block 12 on the retaining wall block 12 when the fluidized concrete is introduced into the mold housing 14 and permitted to cure. The removability of the insert allows for changing the textured surface, if desired. The insert can be made of any suitable material, for example, rubber. Moreover, the bottom side 22 has a plurality of wheels 25, or rollers, preferably four in number, to make the bottom tray 16 movable in and out of the mold housing 14. The wheels 25 should be of sufficient size and strength to handle very heavy rebar re-enforced concrete blocks 12.

The mold housing 14 has a plurality of legs 17 elevating and supporting the main mold housing 14 in order to enable the tray 16 to be received and removed under the housing 14. The mold housing 14 has several sides, an open bottom, and at least one door 24 in one of the sides. In the preferred embodiment, the mold housing 14 has two doors 24*a*, 24*b*. When the mold 10 is to be used to make a retaining wall block 12, the open bottom has the bottom tray 16 installed or situated therein to close the bottom of the mold housing 14. The one or more doors 24 are shaped and of sufficient size to define an opening to enable the retaining wall block 12 to be moved through when opened. The one or more doors 24 are designed to close the one side of the housing 14 when closed. One or more suitable bucklings 29, or clamps, of any suitable conventional design are used to maintain closure of the doors 24*a*, 24*b* when a block 12 is being made. The mold housing 14 has an internal cavity therein that defines an outer shape of the retaining wall block 12. The mold housing 14 has one or more openings, in this example, openings 26*a*, 26B, designed to receive and introduce the fabrication material (e.g., concrete) into the internal cavity.

The internal cavity has a sufficient number of sides 28 that angle inwardly from the doors 24*a*, 24*b* to enable the retaining wall block 12 with commensurate angled sides 32*a*, 32*b* (FIGS. 7A and 7B) to be removed from the internal cavity along with the bottom tray 16 once the block 12 is sufficiently cured. Once the tray 16 with semi-cured block 12 is separated from the mold housing 14, a new tray 16 can be installed in the mold housing 14, and another block 12 can be produced.

Figure 2:
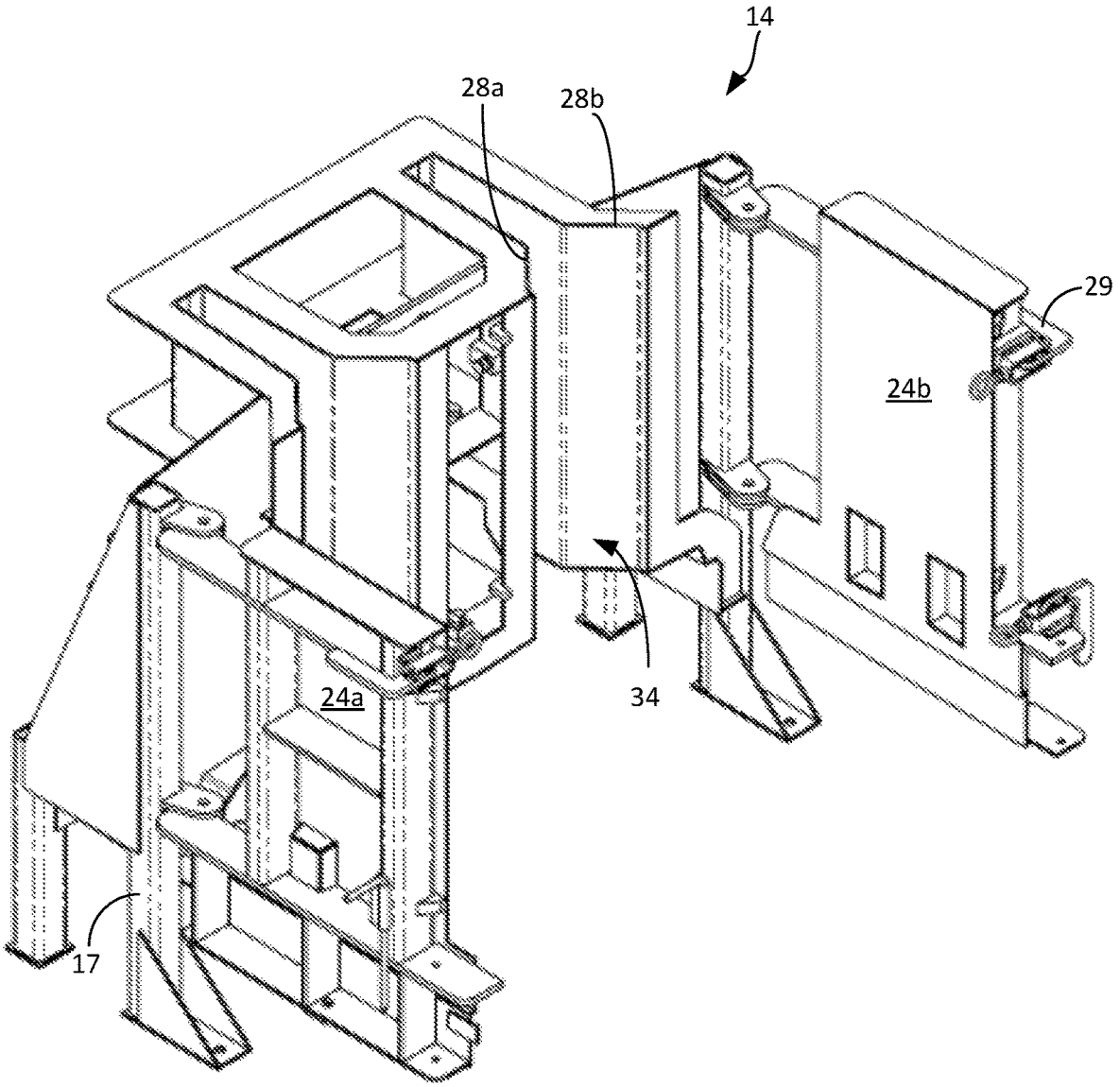
FIG. 2 is a perspective view of the mold of FIG. 1, in an open configuration and without a movable bottom tray.
Figure 3:
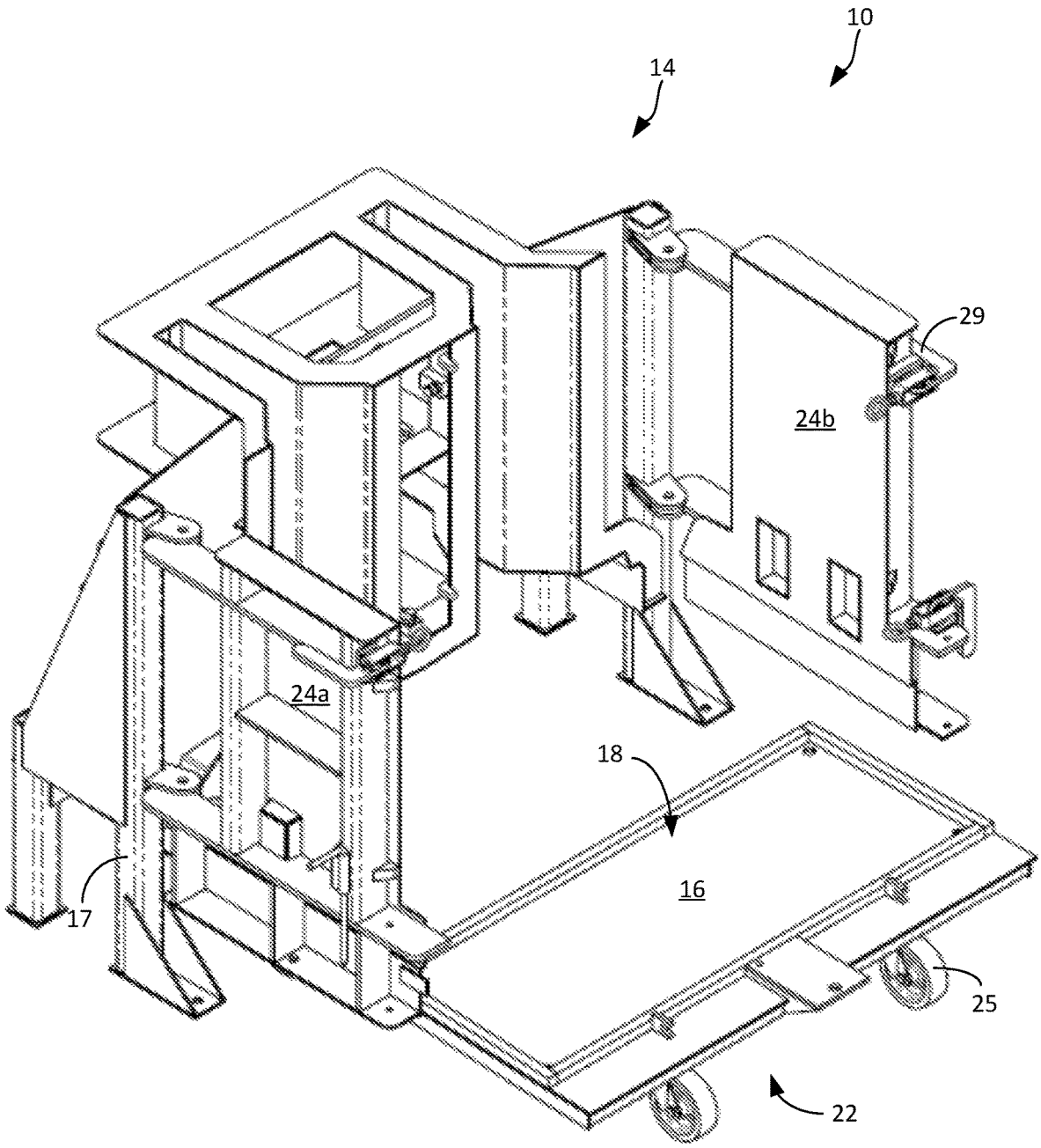
FIG. 3 is a perspective view of the mold of FIG. 1, in an open configuration and with the movable bottom tray separated from the mold housing.
Figure 4:
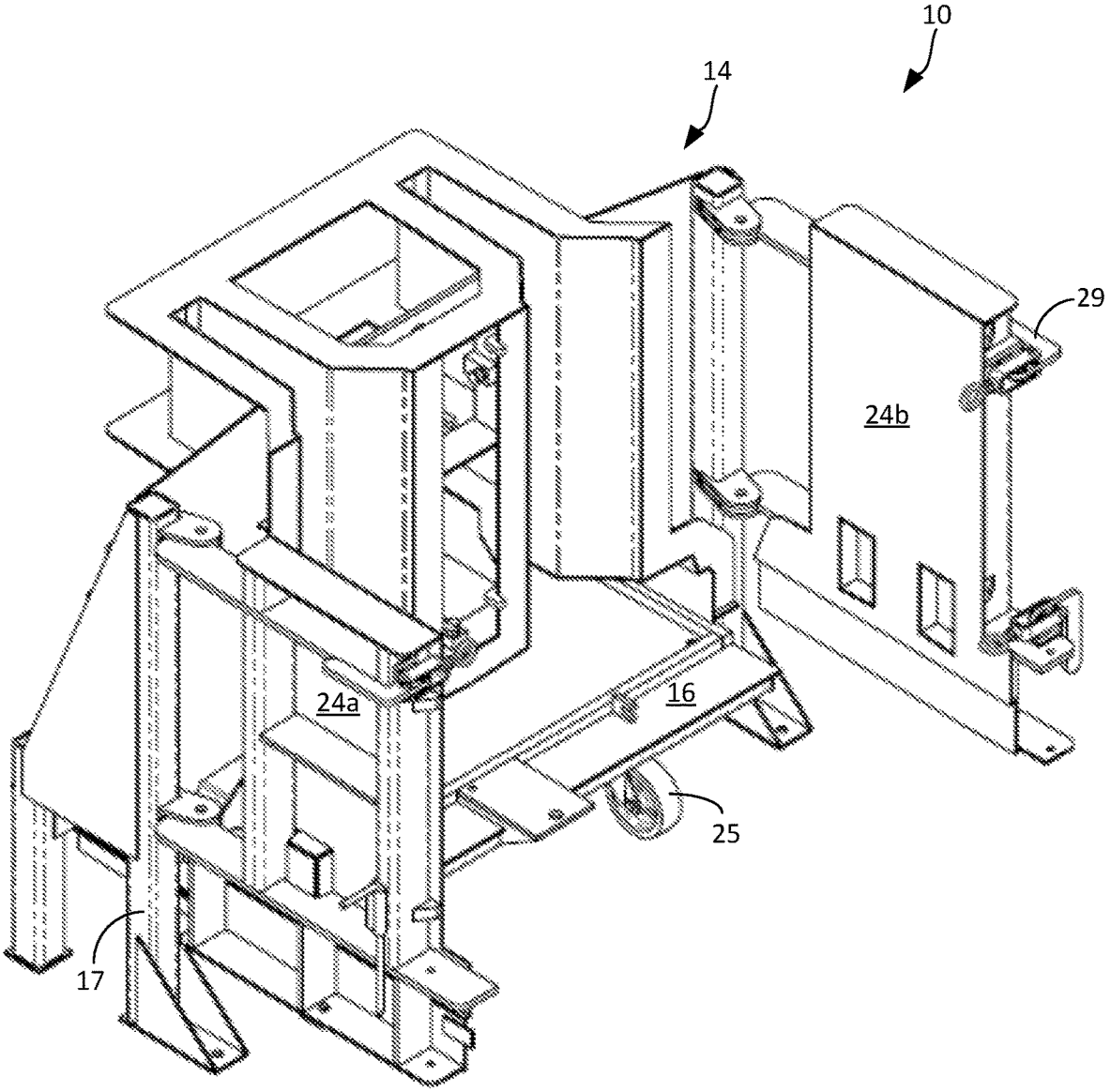
FIG. 4 is a perspective view of the mold of FIG. 1, in an open configuration and with the movable bottom tray installed in the mold housing.
Figure 5:
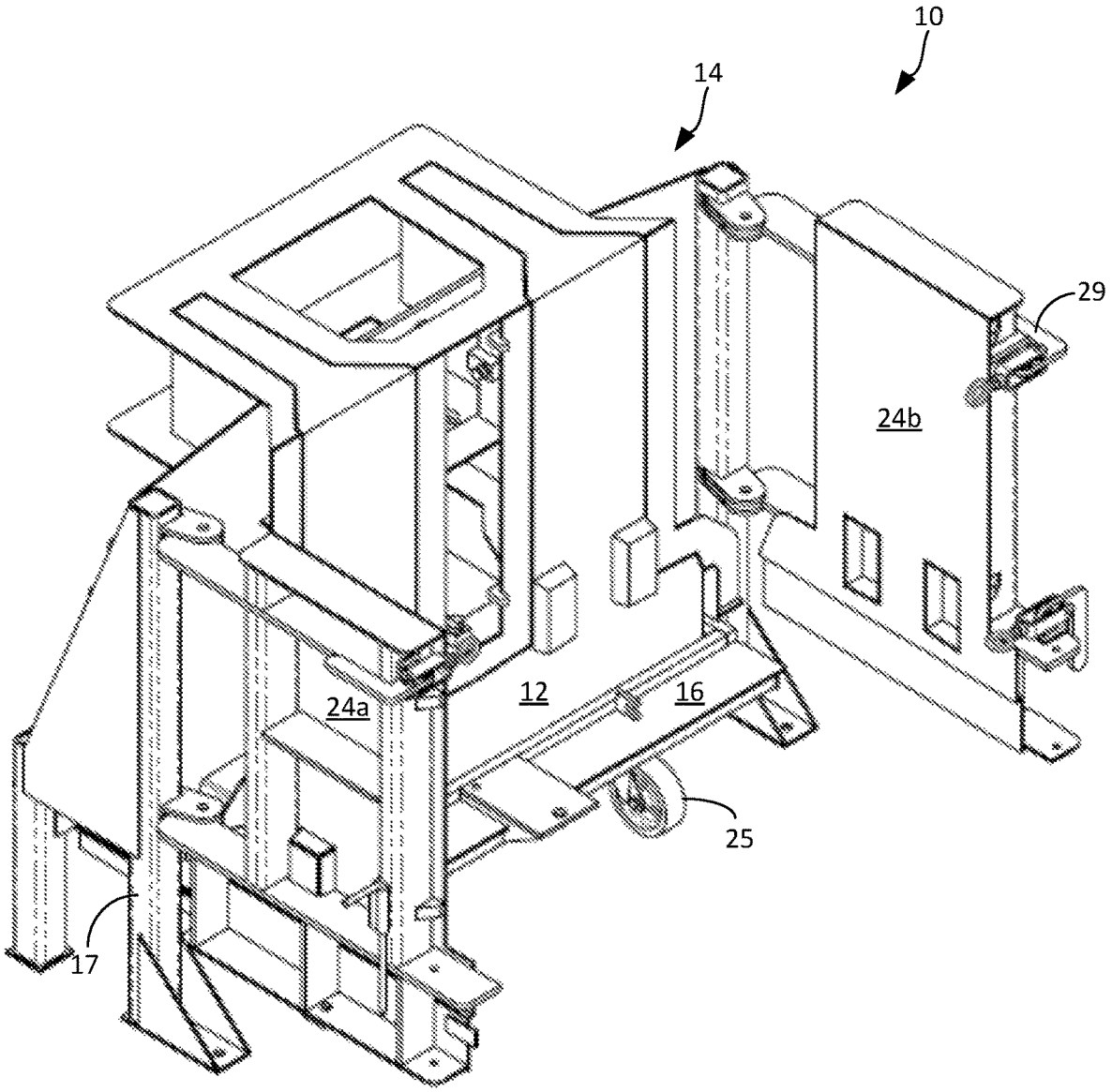
FIG. 5 is a perspective view of the mold of FIG. 1, in an open configuration, with the movable tray installed in the mold housing, and with a cured retaining wall block.
Figure 6:
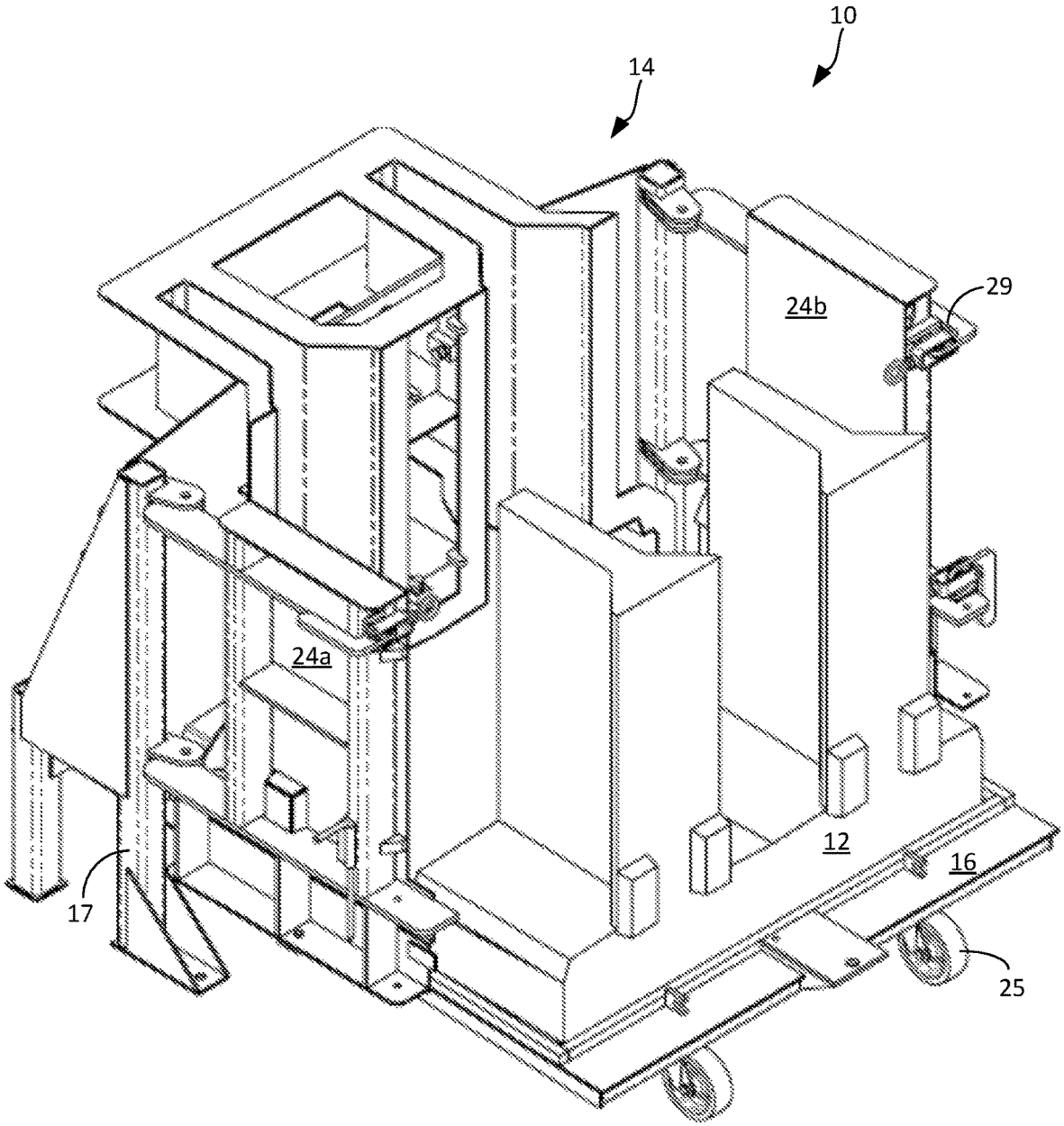
FIG. 6 is a perspective view of the mold of FIG. 1, in an open configuration, with the movable bottom tray separated from the mold housing, and with the cured retaining wall block.

In the preferred embodiment, the internal cavity has a generally planar rectangular bottom defined by the bottom tray 16 and interior sides of the mold housing 14 for creating the front portion 23 of the block 12 and a plurality of upwardly extending stem chambers 34 for creating the stems 38 (FIGS. 7A and 7B) of the block 12. As shown in FIG. 2, each of the stem chambers 34 has left and right sides 28*a*, 28*b* that are angled inwardly from the doors 24*a*, 24*b*. The angled left and right sides 28*a*, 28*b* correspond to and produce the left and right sides 32*a*, 32*b*, respectively, of the stems 38 of the block 12. The angled left and right sides 28*a*, 28*b* enable the retaining wall block 12 to be removed from the internal cavity by moving the block 12 along with the bottom tray 16 once the block 12 is sufficiently cured It should be emphasized that the above-described embodiments, including the preferred embodiment, of the present disclosure are merely possible non-limiting examples of implementations, merely set forth for a clear understanding of the principles of the invention. Many variations and modifications may be made to the above-described embodiments of the present disclosure without departing substantially from the spirit and principles of the present invention. All such modifications and variations are intended to be included herein within the scope of this disclosure.

As an example of an alternative embodiment, it is possible that the bottom tray 16 could be separated from and returned to the mold housing 14 by means other than with wheels 25 on the tray underside. For instance, the tray 16 could possibly be lowered from the mold housing 14 through the floor, depending upon the outer shape (angles, etc.) of the block 12. There would need to be a sufficient number of sides that angle inwardly from the bottom to enable the retaining wall block 12 with commensurate sides to be removed from the internal cavity along with the bottom tray once the block is sufficiently cured.

As another example of an alternative embodiment, it is possible to make the tray 16 movable in a horizontal direction on a track or within a channel for removing and separating the tray 16 from the mold housing 14 without use of wheels 25 on the underside of the tray 16.

As another example of an alternative embodiment, the retaining wall block 12 can be manufactured with only one or more than two of the stems 38 so that the mold housing 10 will have a corresponding number of stem chambers 34 in the internal cavity.

At least the following is claimed:

1. A mold for making a retaining wall block, comprising:

a movable bottom tray;

a mold housing having a plurality of sides and an open bottom, one side of the plurality of sides comprises at least one door, the open bottom having the bottom tray removably situated therein to close the bottom of the mold housing, the at least one door shaped and of sufficient size to define an opening to enable the retaining wall block to be moved through when opened, the at least one door designed to close the one side of the housing when closed, the mold housing having an internal cavity therein that defines an outer shape of the retaining wall block, the mold housing having an opening designed to receive and introduce fabrication material into the cavity, the internal cavity comprising a first stem cavity being fluidly connected to a second stem cavity via a front portion cavity section, and each of the stem cavities having right and left sides that are angled inwardly from the at least one door; and a plurality of legs disposed along an exterior of the mold housing, the plurality of legs being positioned about the mold housing to support the mold housing and elevate the mold housing at a height to support removal and receipt of the movable bottom tray, wherein the angled right and left sides enable the retaining wall block to be removed from the cavity by moving the block along with the bottom tray once the block is sufficiently cured.

2. The mold of claim 1, wherein the bottom tray is generally planar and comprises a top side and a bottom side, the top side of the tray having a removable insert with a textured surface to thereby impose a corresponding textured surface on the retaining wall block when the fabrication material is introduced into the cavity and permitted to cure.

3. The mold of claim 1, wherein the bottom tray is generally planar and comprises a top side and a bottom side, the bottom side having one or more wheels to make the bottom tray movable in and out of the mold housing.

4. The mold of claim 1, wherein the cavity comprises:

a generally planar rectangular bottom portion defined by the bottom tray and interior sides of the mold housing;

wherein the first stem cavity and the second stem cavity extend upwardly from the bottom portion.

5. The mold of claim 1, further comprising the retaining wall block in the cavity within the mold.

6. A mold for making a retaining wall block, comprising:

means for supporting at a bottom of the mold the retaining wall block;

means for housing and defining, in combination with the support means, a cavity, the cavity defining an outer surface of the retaining wall block, the housing means having a means for introducing fluidized fabrication material into the cavity, and the internal cavity comprising a first stem cavity being fluidly connected to a second stem cavity via a front portion cavity section, each of the stem cavities having right and left sides that are angled inwardly from at least one door;

means for enabling movement of the retaining wall block, once sufficiently cured, in combination with the support means, from a side of the housing means to separate the combination from the housing means; and means for supporting and elevating the housing means at a height sufficient for removal and receipt of the means for supporting the retaining wall block, wherein the angled right and left sides enable the retaining wall block to be removed from the cavity by moving the block along the means for supporting at the bottom of the mold once the block is sufficiently cured.

7. The mold of claim 6, wherein the supporting means is generally planar and comprises a top side and a bottom side, the top side having an insert with a textured surface to thereby impose a corresponding textured surface on the retaining wall block when the fabrication material is introduced into the cavity and permitted to cure.

8. The mold of claim 6, wherein the supporting means is generally planar and comprises a top side and a bottom side, the bottom side having one or more wheels to make the support means movable in and out of the housing means.

9. The mold of claim 6, wherein the means for supporting at a bottom of the mold the retaining block comprises a bottom tray, and the means for enabling movement of the retaining wall block comprises one or more doors, and the cavity comprises:

a generally planar rectangular bottom portion defined by the bottom tray and interior sides of the mold housing;

wherein the first stem cavity and the second stem cavity extend upwardly from the bottom portion.

10. The mold of claim 6, further comprising the retaining wall block in the cavity within the mold.

11. A mold for enabling manufacture of a retaining wall block, comprising:

a generally planar movable bottom tray, the tray having a top side and a bottom side, the top side for supporting the retaining wall block, the bottom side having wheels so that the bottom tray is movable and can move the retaining wall block; and a mold housing having a top, right and left sides, and front and back sides, an open bottom, and one or more contiguous doors in one of the sides, the open bottom having the bottom tray situated therein to close the bottom of the mold housing, the one or more contiguous doors shaped and of sufficient size to define an opening to enable the retaining wall block to be moved through when opened, the one or more contiguous doors designed to close the one side of the housing when closed, the mold housing having an internal cavity therein that defines an outer shape of the retaining wall block, the cavity comprising a sufficient number of sides that angle inwardly from the one or more doors to enable the retaining wall block with commensurate sides to be removed from the cavity on the bottom tray once the block is sufficiently cured, the mold housing having one or more openings for receiving and introducing fabrication material into the cavity, and the internal cavity comprising a first stem cavity being fluidly connected to a second stem cavity via a front portion cavity section, each of the stem cavities having right and left sides that are angled inwardly from the one or more doors; and a plurality of legs disposed along an exterior of the mold housing, the plurality of legs being positioned about the mold housing to support the mold housing and elevate the mold housing at a height to support removal and receipt of the movable bottom tray, wherein the angled right and left sides enable the retaining wall block to be removed from the cavity by moving the block along with the bottom tray once the block is sufficiently cured.

12. The mold of claim 11, wherein the top side of the bottom tray has a removable insert with a textured surface to thereby impose a corresponding textured surface on the retaining wall block when the fabrication material is introduced into the cavity and permitted to cure.

13. The mold of claim 11, wherein the fabrication material comprises concrete.

* * * * *